US006081682A

United States Patent [19]

Sasaki et al.

[11] Patent Number: 6,081,682

[45] Date of Patent: Jun. 27, 2000

[54] ORIGINAL SCANNING DEVICE WITH BACKWARD SCANNING CONTROL FEATURE AND RELATED METHOD

[75] Inventors: Ichiro Sasaki, Toride; Mitsuo Nimura, Kashiwa, both of Japan

[73] Assignee: Canon Kabushiki Kaisha, Tokyo, Japan

[21] Appl. No.: 09/184,960

[22] Filed: Nov. 3, 1998

[30] Foreign Application Priority Data

Nov. 11, 1997 [JP] Japan ..... 9-308617

[51] Int. Cl.[7] ..... G03G 15/04; G03G 15/28

[52] U.S. Cl. ..... 399/208; 399/210

[58] Field of Search ..... 399/210, 205, 399/51, 208, 196, 209; 355/67

[56] References Cited

U.S. PATENT DOCUMENTS

| | | | |
|---|---|---|---|
| 4,561,771 | 12/1985 | Sugiura | 399/208 |
| 4,645,328 | 2/1987 | Shiraki et al. | 399/208 |
| 4,707,111 | 11/1987 | Inuzuka et al. | 399/209 |
| 4,996,564 | 2/1991 | Shirasugi | 399/208 |
| 5,119,136 | 6/1992 | Morikawa | 399/208 |
| 5,162,851 | 11/1992 | Asakawa et al. | 399/208 |
| 5,192,975 | 3/1993 | Ide et al. | 399/209 |

*Primary Examiner*—Susan S. Y. Lee

*Attorney, Agent, or Firm*—Fitzpatrick, Cella, Harper & Scinto

[57] ABSTRACT

An original scanning device can set a brake operation starting timing in a scanner backward movement to a predetermined timing, even if a scanning distance of the device is determined at any distance. To do so, a copy machine starts braking the scanning device when a sensor detects that the scanning device backwardly moved to a predetermined position. In this machine, a distance to be scanned by the scanning device is determined based on an original size or a copy magnification, it is judged whether or not a distance between a turn position of the scanning device and the predetermined position according to the determined distance to be scanned is a distance by which the scanning device can reach a predetermined speed in its backward movement, the scanning device is backwardly moved after forwardly moving it to a position according to the determined distance to be scanned in case of affirmative judgment, and the scanning device is backwardly moved after forwardly moving it to a position according to the distance by which the scanning device can reach the predetermined speed in its backward movement in case of negative judgment.

26 Claims, 4 Drawing Sheets

ORIGINAL SCANNING DEVICE WITH BACKWARD SCANNING CONTROL FEATURE AND RELATED METHOD

BACKGROUND OF THE INVENTION

1. Field of the Invention

The present invention relates to an original scanning device (i.e., scanner) which has a scanning means being reciprocated.

2. Related Background Art

In a conventional image reading apparatus which has a scanning device being reciprocated, in order to accurately stop the reciprocated scanner at a home position for next reciprocation, a control is performed to stop the scanner at the home position by starting a brake operation when the scanner backwardly moved (or backed) reaches a predetermined position. Since this control merely requires anytime a constant brake control, the scanner can be accurately backed to the home position without any complicated structure. This control is based on a premise that a scanner speed when the scanner backed to the predetermined position is always maintained at a certain constant speed.

However, in recent copy machines, a maximum speed (especially in backward movement) of the scanner becomes higher than that of the conventional scanner because of improvement in productivity. Inevitably, the scanner speed at the predetermined position in the backward movement also becomes higher, so that a problem occurs when the above brake control is used. That is, when a scanning distance of the scanner is short because an original size is small, a copy magnification is large, or the like; if the scanner is backed from a scan termination position, the scanner speed sometimes does not yet reach the above certain constant speed at the time when the scanner just backed to the predetermined position. Therefore, if the brake operation is started in this state, the scanner undesirably stops at a position before the home position.

SUMMARY OF THE INVENTION

An object of the present invention is to provide an original scanner which can solve the above-described problem.

Another object of the present invention is to provide the original scanner which can be certainly stopped at a target position by a simple brake control.

Other objects of the present invention will become apparent from the following description based on the accompanying drawings.

DETAILED DESCRIPTION OF THE PREFERRED EMBODIMENTS

Figure 1:
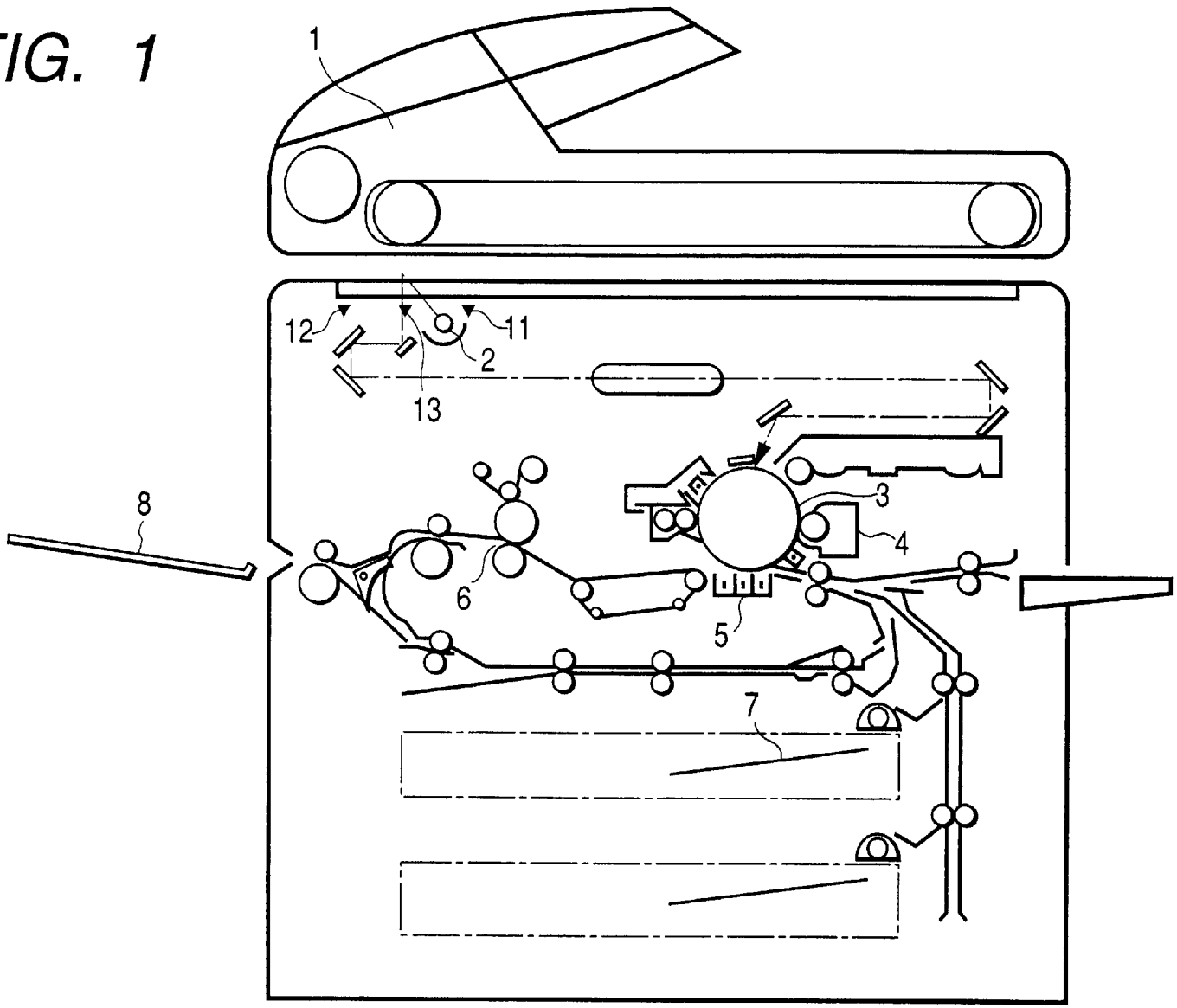
FIG. 1 is a sectional view showing a copy machine according to an embodiment of the present invention.

FIG. 1 is a schematic view of a copy machine in an example of the present invention. Numeral 1 denotes an automatic original feed unit; 2, a scanner (optical system) which includes an original illumination lamp or the like; 3, a photosensitive drum; 4, a development unit; 5, a transfer unit; 6, a fixing unit; 7, a paper cassette; and 8, a paper discharge tray. An original is put on the automatic original feed unit 1, and a desired copy mode is set by an operation panel. Then, a copy operation is started by depressing a start key on the operation panel. The original placed on the unit 1 is automatically fed to a scanning position. When the original is stopped at the scanning position, the scanner 2 starts to read the original to form a latent image on the photosensitive drum 3. The latent image is developed by the development unit 4 by using a toner, and the obtained toner image is transferred onto a recording paper carried from the paper cassette 7 by the transfer unit 5. Then, the toner is softened to be fused by the fixing unit 6 and fixed to the recording paper, and this recording paper is discharged to the paper discharge tray 8.

Figure 2:
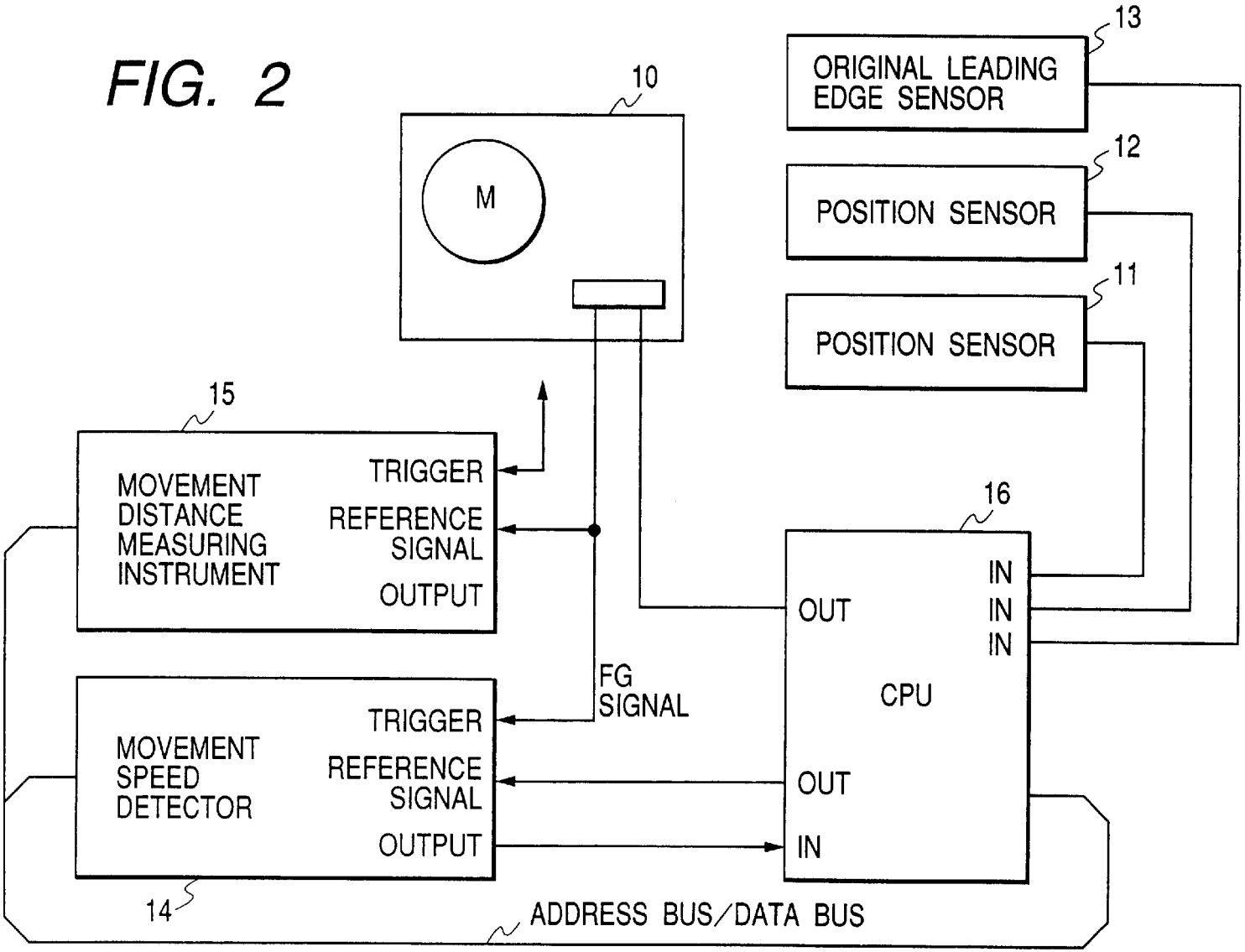
FIG. 2 is a control block diagram of a scanner in the copy machine.

FIG. 2 is a block diagram indicating an example of reciprocation control of the scanner according to the present invention. A motor 10 drives the scanner. A sensor 11 detects that the scanner reaches a predetermined position. A sensor 12 detects that the scanner is at a home position. A sensor 13 detects that a reading position of the scanner 2 reaches an original leading edge. A movement speed detector 14 detects scanner speed. A movement distance measuring instrument 15 measures a movement distance between a predetermined detected position and a stopped position. A CPU 16 controls the movement speed detector 14, the movement distance measuring instrument 15 and the drive motor 10. In the embodiment, the sensors 11 and 13 are separately provided. However, such structure as one sensor detects two positions may be available.

Figure 3:
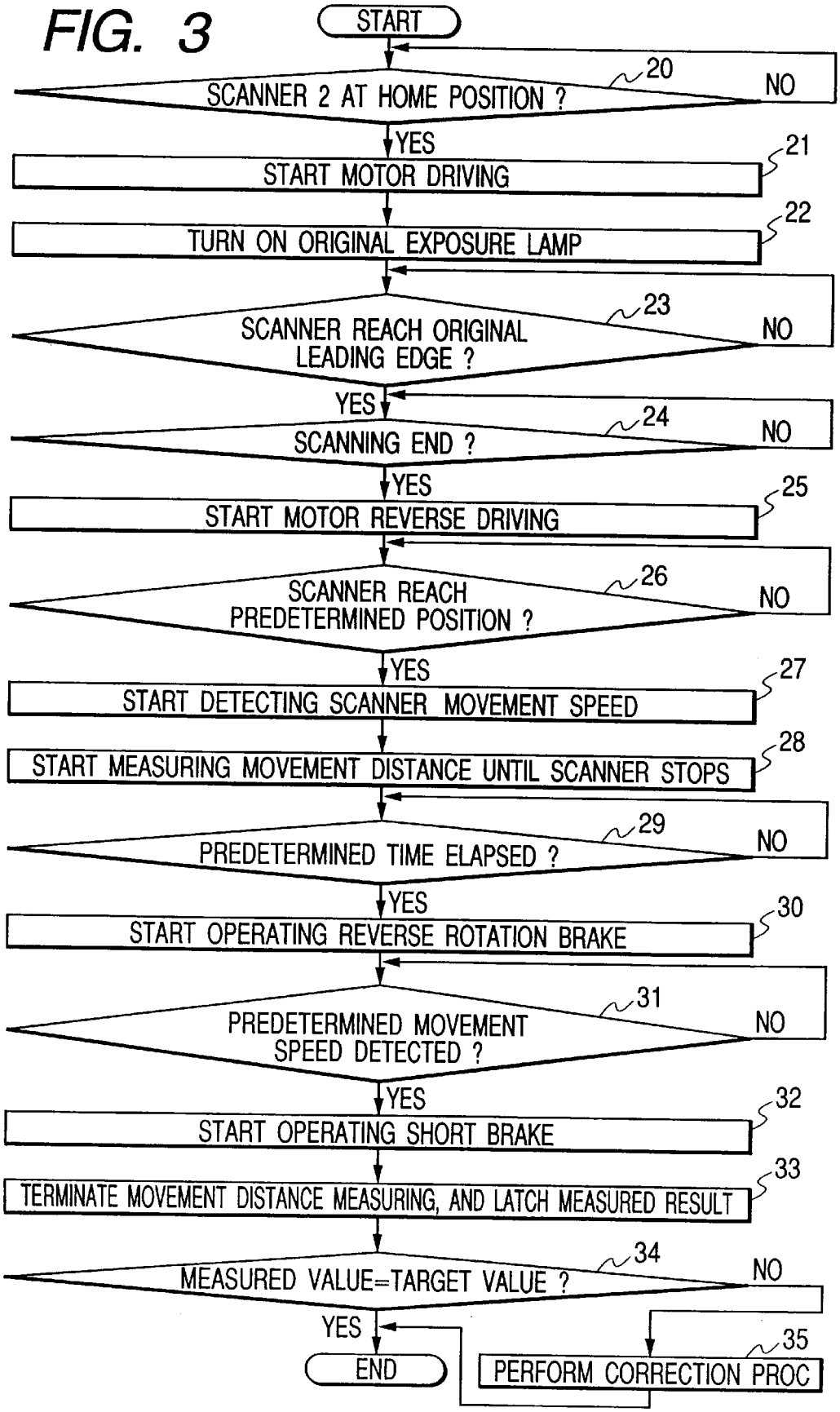
FIG. 3 is a control flowchart of the scanner.

FIG. 3 is a flowchart schematically indicating a control of the scanner 2. Initially, in a step 20, it is judged whether or not the scanner 2 is at the home position by the sensor 12. If the scanner 2 is at the home position, the motor 10 is caused to start a drive at a speed corresponding to a copy setting magnification in a step 21. In a step 22, an original exposure lamp of the scanner 2 is lighted to start a scan. Therefore, the scanner 2 starts a forward movement. In a step 23, the flow waits for a next process until the sensor 13 detects that the scanner 2 reaches the original leading edge. If the original leading edge is detected, in a step 24, the flow waits for a next process until a drive corresponding to a setting distance described later (steps 45 and 46 in FIG. 4) is terminated.

Subsequently, if the scanner 2 reaches a scan termination position (drive corresponding to setting distance is terminated), in a step 25, the motor 10 is reversely driven against a scanning direction for a next scan to start a backward movement of the scanner 2. At this time, the motor 10 performs a startup control such that the scanner speed becomes a predetermined speed until it is detected that the scanner 2 has reached a predetermined position. In a step 26, the flow waits for a next process until the scanner 2 reaches the predetermined position. If it is detected that the scanner 2 reached the predetermined position by the sensor 11, it is started to detect a movement speed of the scanner 2 in a step 27. Then, in a step 28, it is started to measure a movement distance until the scanner 2 stops.

In a step 29, the flow waits for elapsing of a predetermined time. Then, in a step 30, a brake operation for decreasing speed (called as reverse rotation brake hereinafter) is started by driving the motor 10 in the scanning direction (forward movement direction). Subsequently, in a step 31, the flow waits for a next process until a predetermined movement speed is detected. If the predetermined movement speed is detected, in a step 32, the brake operation of the motor 10 is switched from the reverse rotation brake to a short brake to stop the motor 10. Then, in a step 33, it is terminated to measure the movement distance until the scanner 2 stops.

In a step 34, a target stopping distance of the scanner 2 between the predetermined detected position and the stopped position is compared with a measured movement distance. When the different compared result is obtained, such a process as correcting a time from detecting of the predetermined position of the scanner 2 until starting of the reverse rotation brake operation (predetermined time in the step 29) is executed in accordance with a different distance between the target stopping distance of the scanner 2 (between the predetermined detected position and the stopped position) and the measured movement distance in a step 35. Therefore, the scanner can be surely stopped at a target stopping position in a next scan.

Figure 4:
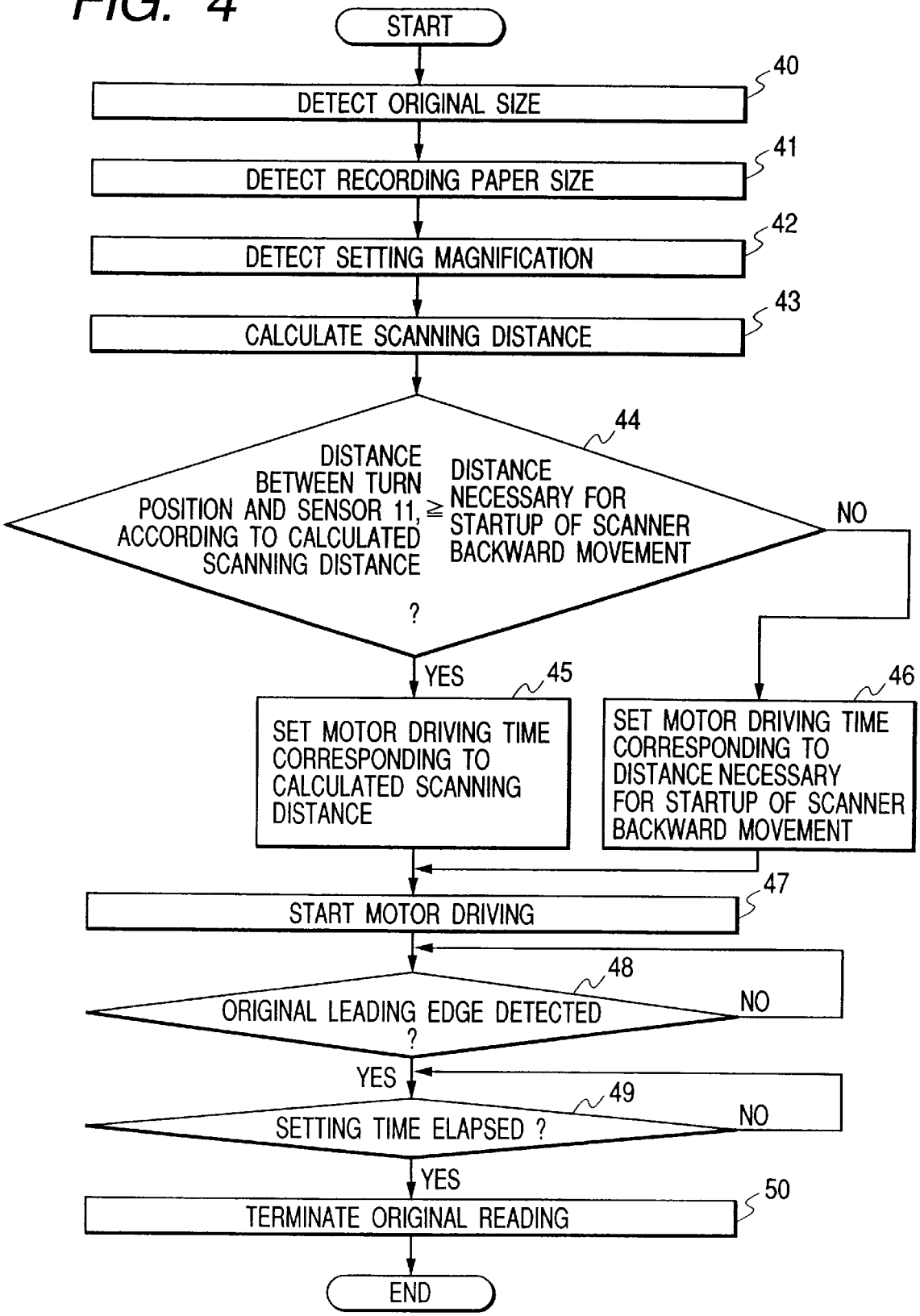
FIG. 4 is a flowchart to control a forward distance of the scanner.

FIG. 4 is a flowchart indicating a control for performing a forward movement of the scanner 2. Initially, in a step 40, an original size is detected. In a step 41, a recording paper size is detected. Then, in a step 42, a setting magnification is detected. In a step 43, a scanning distance is calculated based on detected results of the original size, the recording paper size and the setting magnification. More particularly, in a case where a copy operation is performed by setting the magnification and the recording paper size, the scanning distance is calculated in accordance with the magnification and the recording paper size. When the recording paper size is equal to or smaller than the original size, the calculated scanning distance is determined. When the recording paper size is larger than the original size, the scanning distance corresponding to the original size is determined. In a case where the copy operation is performed by automatically obtaining the magnification in accordance with the original size and the recording paper size, the scanning distance corresponding to the original size is calculated. In a step 44, a distance between a turn position of the scanner 2 and the sensor 11 according to the scanning distance calculated in the step 43 is compared with a distance necessary for startup of the scanner 2 backward movement (reaching predetermined speed). As a compared result, if the distance between the turn position and the sensor 11 according to the calculated scanning distance is equal to or longer than the distance necessary for startup of the scanner backward movement, set a motor driving time corresponding to the scanning distance of calculated result in a step 45. If the distance between the turn position and the sensor 11 is less than the distance necessary for startup of the scanner backward movement, set a motor driving time corresponding to the distance necessary for startup of the scanner 2 backward movement in a step 46. Then, in steps 47 to 50, the motor 10 is driven for the time set in the steps 45 and 46 to forwardly move the scanner 2.

In this manner, in the case of scanning any sized original, the motor 10 is controlled such that a forward movement distance of the scanner 2 equals or exceeds such a distance as the scanner 2 can reach the predetermined speed in the backward movement.

Similarly, in case of scanning the original at any magnification, the motor 10 is controlled such that the forward movement distance of the scanner 2 equals or exceeds such the distance as the scanner 2 can reach the predetermined speed in the backward movement.

Therefore, the speed of the scanner 2 when it backwardly moved to the predetermined position reaches the predetermined speed.

Therefore, when a brake operation in the backward movement is started, since such a situation as speed of the scanner 2 does not reaches the predetermined speed because of the forward movement distance in a large magnification or a small sized original can be eliminated, it becomes possible to surely stop the scanner 2 at the target position by using a common brake control.

It should be noted that the present invention can be realized by replacing a motor driving time with motor rotation number or a movement distance of the scanner 2.

The present invention is not limited to the above-described embodiments, so that various modifications are possible within the spirit and scope of the appended claims.

What is claimed is:

1. An original scanning device comprising:

scanning means reciprocating to scan an original;

detection means for detecting that said scanning means reaches a predetermined position in its backward movement;

brake means for braking said scanning means in accordance with a detection result of said detection means;

determination means for determining a distance to be scanned by said scanning means;

judgment means for judging whether a distance between a turn position of said scanning means and the predetermined position is a distance by which said scanning means can reach a predetermined speed in its backward movement; and control means for backwardly moving said scanning means after forwardly moving said scanning means to a position according to the distance to be scanned if said judgment means judges that the distance to be scanned is a distance in which said scanning means achieves a predetermined speed in its backward movement, and backwardly moving said scanning means after forwardly moving said scanning means to a position according to the distance by which said scanning means achieves the predetermined speed in its backward movement if said judgment means judges that the distance to be scanned is not the distance in which said scanning means can achieve the predetermined speed in its backward movement.

2. A device according to claim 1, further comprising original size detection means for detecting an original size, and wherein said determination means determines the distance to be scanned in accordance with a detected result of said original size detection means.

3. A device according to claim 1, further comprising:

copy paper size detection means for detecting a copy paper size; and magnification detection means for detecting a copy magnification, and wherein said determination means determines the distance to be scanned in accordance with detected results of said copy paper size detection means and said magnification detection means.

4. A device according to claim 1, further comprising:

brake distance detection means for detecting a brake distance depending on said brake means; and correction means for correcting a next brake operation starting timing of said brake means in accordance with a detected result of said brake distance detection means.

5. An original scanning device comprising:

scanning means reciprocating to scan an original;

brake means for braking said scanning means in accordance with said scanning means reaching a predetermined position in its backward movement; and control means for controlling said scanning means to backwardly move said scanning means after forwardly moving said scanning means to a position as a function of a distance in which said scanning means achieves a predetermined speed in its backward movement, wherein, even in a case of scanning the original of any size, a forward movement distance of said scanning means is equal to or longer than the distance in which said scanning means achieves the predetermined speed in its backward movement.

6. A device according to claim 5, wherein said scanning means includes, exposure means for exposing the original, and image formation means for forming an image on a sheet in accordance with an original image exposed by said exposure means.

7. An original scanning device comprising:

scanning means reciprocating to scan an original;

braking means for braking said scanning means in accordance with said scanning means reaching a predetermined position in its backward movement; and control means for controlling said scanning means to backwardly move said scanning means after forwardly moving said scanning means to a position as a function of a distance in which scanning means achieves a predetermined speed in its backward movement, wherein, even in case of scanning the original at any magnification, a forward movement distance of said scanning means is equal to or larger than the distance in which said scanning means achieves the predetermined speed in its backward movement.

8. A device accordance to claim 7, wherein said scanning means further comprises:

exposure means for exposing the original; and image formation means for forming an image on a sheet in accordance with an original image exposed by said exposure means.

9. An original scanning device comprising:

scanning means reciprocating to scan an original;

braking means for braking said scanning means in accordance with said scanning means reaching a predetermined position in its backward movement;

control means for controlling said scanning means to backwardly move said scanning means after forwardly moving said scanning means to a position as a function of a distance in which said scanning means achieves a predetermined speed in its backward movement;

a brake distance detection means for detecting a braked distance by said braking means; and correction means for correcting a next brake operation starting timing of said braking means in accordance with a detected result of said brake distance detection means.

10. A device according to claim 9, wherein said scanning means further comprising:

exposure means for exposing the original; and image formation means for forming an image on a sheet in accordance with an original image exposed by said exposure means.

11. An original scanning device comprising:

scanning means reciprocating to scan an original;

braking means for braking said scanning means in accordance with said scanning means reaching a predetermined position in its backward movement;

control means for controlling said scanning means to backwardly move said scanning means after forwardly moving said scanning means to a position as a function of a distance in which said scanning means achieves a predetermined speed in its backward movement;

detection means for detecting that said scanning means moves to the predetermined position; and speed detection means for detecting that a speed of said scanning means is reduced to a predetermined speed, wherein said braking means performs a first brake operation and a second brake operation, and performs the first brake operation in accordance with a detection result of said detection means and the second brake operation in accordance with a detection result of said speed detection means.

12. A device according to claim 11, wherein said scanning means further comprises:

exposure means for exposing the original; and image formation means for forming an image on a sheet in accordance with an original image exposed by said exposure means.

13. A device according to claim 11, wherein the first brake operation is a reverse brake operation and the second brake operation is a short brake operation.

14. A control method for an original scanning device, which includes scanning means reciprocating to scan an original, said method comprising the steps of:

detecting that the scanning means reaches a predetermined position in its backward movement;

braking the scanning means in accordance with a detection result in said detecting step;

determining a distance to be scanned by the scanning means;

judging whether a distance between a turn position of the scanning means and the predetermined position is a distance by which the scanning means achieves a predetermined speed in its backward movement; and controlling the scanning means so as to backwardly move the scanning means after forwardly moving the scanning means to a position according to the distance to be scanned if said judging step judges that the distance to be scanned is a distance in which the scanning means achieves a predetermined speed in its backward movement, and backwardly moving the scanning means after forwardly moving the scanning means to a position according to the distance by which the scanning movement if said judging step judges that the distance to be scanned is not the distance in which the scanning means can achieve the predetermined speed in its backward movement.

15. A method according to claim 14, further comprising a step of detecting an original size, wherein said determining step determines the distance to be scanned in accordance with a detected result in said original size detecting step.

16. A method according to claim 14, further comprising the steps of:

detecting a copy paper size; and detecting a copy magnification, and wherein said determining step determines the distance to be scanned in accordance with detected results in said copy paper size detecting step and said copy magnification detecting step.

17. A method according to claim 14, further comprising the steps of:

detecting a brake distance depending on the operation in said braking step; and correcting a next brake operation starting timing in said braking step in accordance with a detecting result in said brake distance detecting step.

18. A control method for an original scanning device, which includes scanning means reciprocating to scan an original, said method comprising the steps of:

braking the scanning means in accordance with the scanning means reaching a predetermined position in its backward movement; and controlling the scanning means to backwardly move the scanning means after forwardly moving the scanning means to a position as a function of a distance in which the scanning means achieves a predetermined speed in its backward movement, wherein, even in case of scanning the original of any size, a forward movement distance of the scanning means is equal to or longer than the distance in which the scanning means achieves the predetermined speed in its backward movement.

19. A method according to claim 18, further comprising the steps of:

exposing the original; and forming an image on a sheet in accordance with an original image exposed in said exposing step.

20. A control method for an original scanning device, which includes scanning means reciprocating to scan an original, said method comprising the steps of:

braking the scanning means in accordance with the scanning means reaching a predetermined position in its backward movement; and a control step of controlling the scanning means to backwardly move the scanning means after forwardly moving the scanning means to a position as a function of a distance in which the scanning means achieves a predetermined speed in its backward movement, wherein, even in case of scanning the original at any magnification, a forward movement distance of the scanning means is equal to or larger than the distance in which the scanning means achieves the predetermined speed in its backward movement.

21. A method according to claim 20, further comprising the steps of:

exposing the original, and forming an image on a sheet in accordance with an original image exposed in said exposing step.

22. A control method for an original scanning device, which includes scanning means reciprocating to scan an original, said method comprising:

braking the scanning means in accordance with the scanning means reaching a predetermined position in its backward movement;

controlling the scanning means to backwardly move the scanning means after forwardly moving the scanning means to a position as a function of a distance in which the scanning means achieves a predetermined speed in its backward movement;

detecting a brake distance in said braking step; and correcting a next brake operation starting timing in said braking step in accordance with a detected result in said brake distance detecting step.

23. A method according to claim 22, further comprising the steps of:

exposing the original; and forming an image on a sheet in accordance with an original image exposed in said exposing step.

24. A control method for an original scanning device, which includes scanning means reciprocating to scan an original, said method comprising the steps of:

braking the scanning means in accordance with the scanning means reaching a predetermined position in its backward movement;

controlling the scanning means to backwardly move the scanning means after forwardly moving the scanning means to a position as a function is a distance in which the scanning means achieves a predetermined speed in its backward movement;

detecting that the scanning means moves to the predetermined position; and detecting that a speed of the scanning means is reduced to a predetermined speed, wherein said braking step performs a first brake operation and a second brake operation, and performs the first brake operation in accordance with a detection result in said detecting step and the second brake operation in accordance with a detection result in said speed detecting step.

25. A method according to claim 24, wherein the first braked operation is a reverse brake operation and the second brake operation is a short brake operation.

26. A method according to claim 24, further comprising the steps of:

an exposure step of exposing the original, and an image formation step of forming an image on a sheet in accordance with an original image exposed in said exposing step.

* * * * *

UNITED STATES PATENT AND TRADEMARK OFFICE

CERTIFICATE OF CORRECTION

PATENT NO. : 6,081,682

DATED : June 27, 2000

INVENTOR(S) : ICHIRO SASAKI, ET AL.

It is certified that error appears in the above-identified patent and that said Letters Patent is hereby corrected as shown below:

COLUMN 1
Line 18, "anytime" should be deleted.

COLUMN 2
Line 54, "reached" should read --has reached--; and
Line 61, "as" should read --a--.

COLUMN 3
Line 59, "such the" should be deleted; and
Line 67, "reaches" should read --reach--.

COLUMN 5
Line 26, "scanning" should read --said scanning--;
Line 33, "accordance" should read --according--; and
Line 57, "comprising:" should read --comprises:--.

UNITED STATES PATENT AND TRADEMARK OFFICE

CERTIFICATE OF CORRECTION

PATENT NO. : 6,081,682

DATED : June 27, 2000

INVENTOR(S) : ICHIRO SASAKI, ET AL.

It is certified that error appears in the above-identified patent and that said Letters Patent is hereby corrected as shown below:

COLUMN 6

Line 48, "if" should read --in--; and

Line 61, "and" should be deleted.

COLUMN 8

Line 28, "is" should read --of--; and

Line 42, "braked" should read --brake--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*